United States Patent [19]

Wunsche

[11] 4,210,160

[45] Jul. 1, 1980

[54] ANTI-POLLUTION COMBUSTION DEVICE

[76] Inventor: Anton E. Wunsche, 656 W. 162 St., New York, N.Y. 10032

[21] Appl. No.: 11,062

[22] Filed: Feb. 12, 1979

Related U.S. Application Data

[63] Continuation-in-part of Ser. No. 764,852, Feb. 3, 1977, abandoned.

[51] Int. Cl.[2] ..... A24F 1/08; A24F 1/06; A24F 1/32; A24F 3/02

[52] U.S. Cl. ..... 131/194; 131/201; 131/202; 131/204; 131/205; 131/214; 131/219; 131/224; 131/225; 131/226; 131/229; 131/230; 131/245

[58] Field of Search ..... 131/194, 219, 228, 224, 131/226, 204, 205, 230, 201, 202, 140, 225, 206, 214, 215 R, 215 A, 215 B, 223, 227, 229, 230, 245, 243, 196

[56] References Cited

U.S. PATENT DOCUMENTS

| | | | |
|---|---|---|---|
| 1,161,519 | 11/1915 | Peterson | 131/205 |
| 1,668,568 | 5/1928 | Miller | 131/215 R |
| 2,385,312 | 9/1945 | Swift | 131/194 |
| 2,419,509 | 4/1947 | Turner | 131/202 |
| 2,467,002 | 4/1949 | Atkins | 131/198 K |
| 2,654,370 | 10/1953 | Smith | 131/202 |
| 2,770,240 | 11/1956 | Stauber | 131/203 |
| 2,790,445 | 4/1957 | Berry | 131/215 A |
| 2,926,672 | 3/1960 | Haggblad | 131/229 |
| 3,292,639 | 12/1966 | Zaritka | 131/204 |
| 3,352,309 | 11/1967 | Kaul | 131/245 |
| 3,422,821 | 1/1969 | Calkins | 131/203 |

FOREIGN PATENT DOCUMENTS

| | | | |
|---|---|---|---|
| 6307 | of 1891 | United Kingdom | 131/205 |

*Primary Examiner*—V. Millin

[57] ABSTRACT

An anti-pollution combustion device has a bowl in the interior of which is located, above the connection between the bowl and stem, a perforated metal disc so that the tobacco rests on the same. The outside of the bowl is formed with circumferentially extending cooling ribs. The inside of the bowl is lined with a material which prevents the wood of the bowl from charring. In the smoke passage of the stem is incorporated a filter which can be changed when it is saturated with contaminants. Near the rear end of the stem there is provided a trap with a reservoir in which liquid is trapped and accumulated so that from time to time it can be discharged from the reservoir. The rear end of the stem is provided with a mouthpiece having an annular member projecting transversely of the elongation of the stem and large enough to securely retain the mouthpiece between the teeth of a user, even if the user should have false teeth. A tubular insert may be held in the bowl by the anti-charring compound and serves to prevent overheating of the bowl, promotes combustion and further protects the bowl against charring. The metal disc may rest on a flange at the lower end of the insert or it may be of one piece with the same in form of a transverse wall.

9 Claims, 10 Drawing Figures

ANTI-POLLUTION COMBUSTION DEVICE

This application is a continuation-in-part of my copending application Ser. No. 764,852, filed Feb. 3, 1977 and now abandoned.

BACKGROUND OF THE INVENTION

This invention relates to an anti-pollution combustion device.

Many attempts have been made to eliminate tar and nicotine from the smoke of pipes. Also, many attempts have been made to eliminate the "biting" sensation felt by pipe smokers on their tongues and resulting from the smoke, as well as the unpleasant taste which is experienced when accumulated liquid from the pipe reaches the tongue of the user.

Despite all attempts, however, there is no pipe known to me which satisfactorily solves these problems.

SUMMARY OF THE INVENTION

The novel device disclosed herein avoids these problems and assures pleasant and healthy smoking for a user.

Moreover, it is relatively simple in construction and is easy to take care of.

Another advantage is that my new device drastically reduces the amount of tar and nicotine in the smoke, thus not only saving the health of a user but also reducing the amount of these contaminants which is exhaled into the atmosphere.

My novel pipe may comprise a pipe stem having a front end portion and a rear end portion provided with a mouthpiece. A smoke passage extends in the stem between these end portions. At the front end portion there is provided a bowl having the usual tobacco chamber the interior of which is lined with a combustion-resistant lining to prevent the wood of the bowl from charring. The outside of the bowl is provided with circumferentially extending cooling ribs to dissipate heat. In the tobacco chamber, above the hole communicating the chamber with the smoke passage of the stem, there is lodged a perforated metal disc on which the tobacco to be burned rests. Interposed in the smoke passage of the stem is a replaceable filter. Intermediate the filter and the mouthpiece the stem is formed with a liquid trap which can be emptied whenever necessary and which prevents liquid from reaching the mouth of a user.

Hereafter the invention will be described with reference to currently preferred specific embodiments of the invention, as illustrated in the drawing. However, the novel aspects of the invention are not to be considered limited to the illustrated embodiments, but instead are exclusively defined in the claims which are appended hereto.

DESCRIPTION OF PREFERRED EMBODIMENTS

Figures 1, 2, 3, 4, 5, 6, 7, 8:
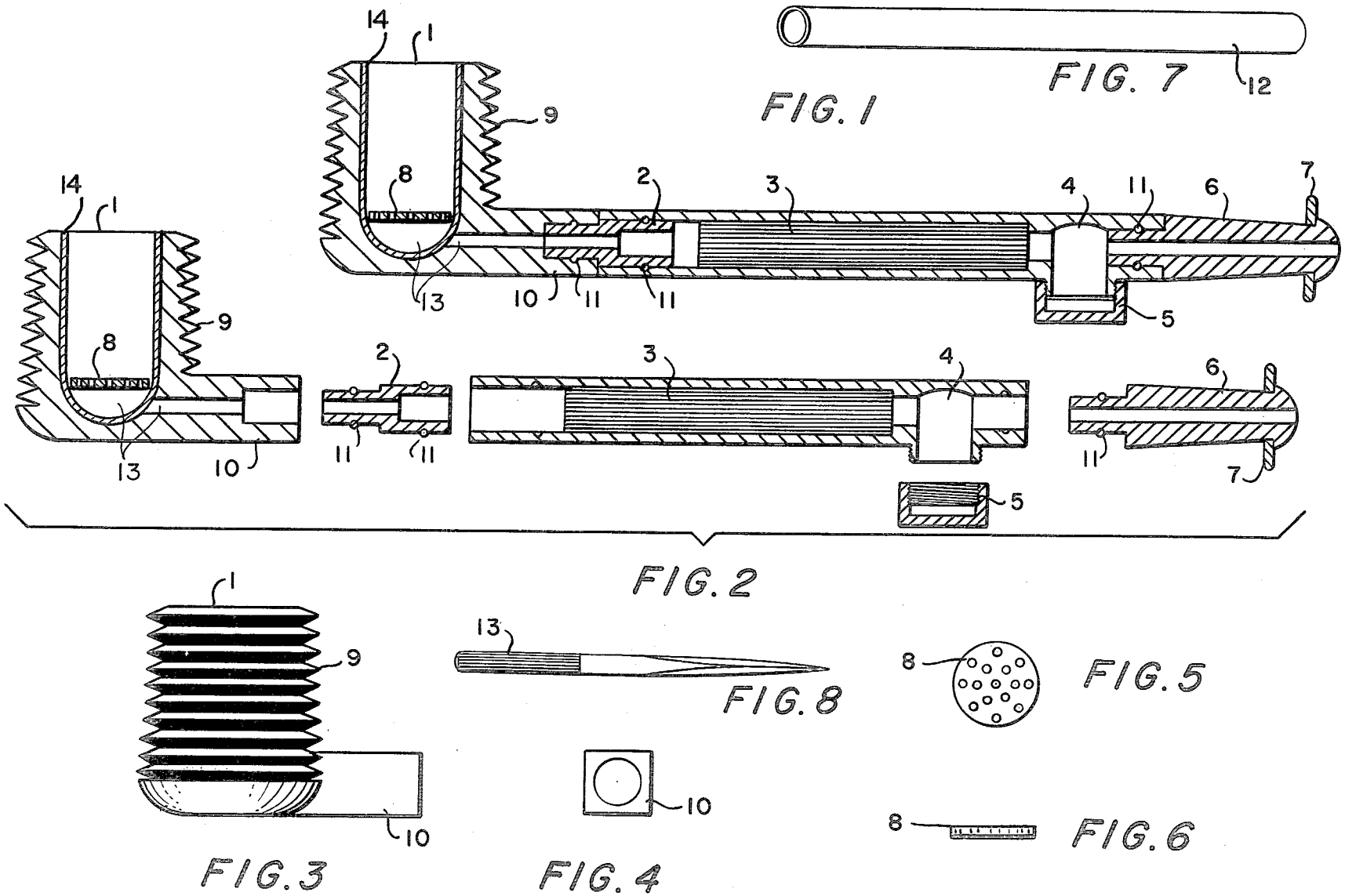
FIG. 1 is a longitudinal section through a novel pipe according to my invention.
FIG. 2 is an exploded view of the pipe in FIG. 1.
FIG. 3 is a fragmentary side view of FIG. 1.
FIG. 4 is a cross-section through the pipe stem.
FIG. 5 is a top plan view of a pipe bowl insert.
FIG. 6 is an edge view of the insert in FIG. 5.
FIG. 7 is a side perspective of a detail.
FIG. 8 shows a cleaning tool for the pipe.

The pipe I have illustrated in FIGS. 1-8 has a pipe bowl I provided with the usual interior tobacco chamber. If the pipe bowl 1 is made of wood, in the usually preferred manner, then I line the tobacco chamber with a lining 14 of material suitable to prevent charring of the wood, i.e. eventual burning-through of the bowl. Such material may be or include a combination of magnesite, dolomite, kaolin, sodium silicate or feldspar. The coating 14 might also be provided in form of a prefabricated insert of requisite size and shape.

The exterior of the pipe bowl is provided with a plurality of circumferentially extending cooling ribs 9 which dissipate the heat of combustion and eliminate the heretofore so objectionable heating of the bowl to the point where it can no longer be comfortably held by a user.

The bowl 1 is detachably mounted or, as shown, is of one piece with, a stem 10. The stem 10 has a front end portion which in the illustrated embodiment is one piece with the bowl, and a rear portion which is connected to the front end portion as shown (see FIG. 2). The rear portion accomodates in its tobacco smoke passage a replaceable filter 3 of suitable fibrous material, such as natural fibers (e.g. cotton) or synthetic fibers. The filter 3 traps tar and nicotine and can be readily replaced with a new one whenever it is saturated. The rear portion of stem 10 is connected to the front end portion thereof with a connecting member 2 which fits tightly into the rear end of the front end portion and the front end of the rear portion, respectively; O-rings 11 establish the desired seal. Filter 3 can be dislodged by inserting the cleaning and tamping rod 13 (see FIG. 8) into the smoke passage of the stem from the rear end thereof (see FIG. 2).

Rearwardly of the filter 3 the stem is provided with a liquid trap 4 which opens downwardly and can be closed by an internally threaded cap 5 the threads of which mesh with corresponding threads on the stem. However, a friction fit would also be suitable. Liquid becomes trapped via chamber 4 in cap 5 from where it is discharged from time to time by the user. My trials have shown that no liquid whatever reaches the mouth of a user with this arrangement. The smoke is completely dry and pleasant; the objectionable "bite" and the unpleasant taste found in other pipes are eliminated.

A mouthpiece 6 is insertable into the opening of the smoke passage at the rear end of the rear portion of stem 10. For this purpose the front end of mouthpiece 6 has a reduced-diameter part which is provided with another O-ring to establish a proper seal. I prefer the smoke passage in mouthpiece 6 to be of circular section rather than oval as is usual in all other pipes, because it permits the passage to be cleaned more easily; also, clogging of the passage is less likely. In fact, the entire smoke passage in stem 10 is preferably also of this cross-section for the aforementioned reasons and also to facilitate liquid flow to the trap 4, 5. The rear end of mouthpiece 7 is provided with a ring of rubber or the like; the ring has numeral 7 and should be so large that it can be readily retained between the teeth of a user, even a user having a set of dentures.

Mounted in the tobacco chamber of bowl 1 is a perforated insert disc 8 of suitable metal. The disc 8 (see also FIGS. 5 and 6) is loosely placed into the bowl so that it can be removed by turning the bowl 1 upside down and tapping it. Disc 8 is so dimensioned that it is seated in the tobacco chamber upwardly of the point where the smoke passage of stem 10 communicates with the lower end of the chamber (see FIGS. 1 and 2). The tobacco to be burned is placed on top of the disc 8 so that it cannot come into contact with moisture which forms in the bottom of the chamber.

In FIG. 7 I have shown a tamping tube which is used for tamping the burning tobacco in bowl 1. The use of this tube 12 permits the tobacco to be mixed up so that fresh air can always have access to the lower layers of the tobacco charge.

I have found that substantially the entire tobacco charge burns in my pipe, which is to say that all that is left will be ashes whereas in the known pipes as much as 30% unburned tobacco will be mixed with the ashes and will not be combustible because it has become too much moistened by the moisture which collects at the bottom of the tobacco chamber. This is avoided by my insert 8, which also prevents the hole connecting the tobacco chamber with the smoke passage of the pipe stem 10 from becoming clogged.

My pipe does not afflict the user with the usual bitter, biting sensation on his tongue and the usual tendency to "spit out" the unpleasant taste of the pipe moisture is no longer encountered. A user does not have a tickling or burning sensation in his throat and the smoke has little or no effect on his lungs. In fact, even persons suffering from asthma can smoke my pipe. The smoke is cool and absolutely dry and nicotine and other contaminants are entrapped in the filter and the trap 4, 5 due to the cooling of the smoke in the long filter 3 and smoke passage of the stem 10, so that the smoke issuing from the mouthpiece 6 is gray and substantially freed of nicotine. It is aromatic and pleasant.

Figure 9:
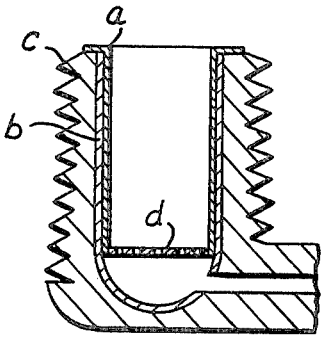
FIG. 9 is a sectional view, showing a further embodiment of the invention.
Figure 10:
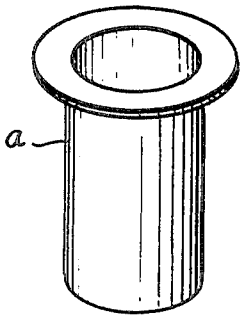
FIG. 10 is a perspective view, showing an element of the embodiment in FIG. 9.

A further embodiment of the invention is shown in FIGS. 9 and 10. This is directed to solving certain problems in addition to those outlined earlier; namely the fact that in conventional pipes the bowl often tends to overheat and may then burn the user's fingers, and the equally unpleasant tendency of wooden pipe bowls to burn out very fast, regardless of the wood being used. The latter problem is aggravated by the need to scratch accumulated carbon and other deposits out from the pipe bowl, during which operation new surface portions of the pipe-bowl wood are always exposed to charring by the heat of the burning tobacco. Evidently, the thinner the wall of the pipe bowl becomes, the hotter it will get to the touch and the more uncomfortable for a user to hold; it must be remembered, in this connection, that the temperature in a pipe bowl may rise as high as 800° C. Depending on the type of wood used for the bowl, and the smoking habits of a user, a new pipe bowl may actually burn out after only three uses. Finally, there is the fact that new pipes must be "broken in" until they are ready to deliver full smoking enjoyment. This is a process which requires a fair degree of care and patience and which is, as a rule, not enjoyed by pipe smokers who usually consider it somewhat of an onerous chore.

The embodiment in FIGS. 9 and 10 is designed to overcome these problems. As shown in FIG. 9 I provide the interior of the pipe bowl which a tubular metal insert a which is open at its upper end but is closed at its lower end by a transverse wall provided with a plurality (a grid) of apertures d. The upper end of the insert advantageously has a flange surrounding it which rests on the upper edge of the pipe bowl, as shown, to hold the insert a in proper position. It is important for proper burning of the tobacco—and to keep the tobacco dry and out of liquid collecting at the bottom of the bowl—that the transverse wall at the lower end of the insert a be located above the level of the air passage connecting the pipe bowl with the (not illustrated) mouthpiece of the pipe. To hold the insert a permanently in place, i.e. to make it an integral part of the pipe bowl, the interior of the bowl is coated with a layer b of a ceramic compound (e.g. of the type which is currently being used to make entire pipes and therefore known per se) which bonds to the insert a and to the pipe bowl c. The insert a holds the tobacco totally out of contact with the pipe bowl itself, and with the liquid collecting therein, thereby forcing the tobacco to burn up completely so that only ashes remain. Tests have shown that because of this effect, much lower tar and nicotine levels are present in the smoke of a pipe according to the invention, as compared to pipes without the insert a.

Also, the heat in the bowl can escape faster than before and the pipe bowl does not get as hot as bowls without the insert a. This leads to cooling of the smoke and further cooling of the same takes place in the compartments 3 and 4 (see FIGS. 1–8) which can, of course, be employed in a pipe having the features disclosed in FIGS. 9 and 10. Such a combination of features ensures an absolutely cool and aromatic smoke which is dry and pleasant.

Accumulated carbon can be readily scratched off the inner wall of the insert a and there will evidently be no damage to the wood of the pipe bowl c, especially since the wood is further protected by the ceramic coating b. This, of course, makes it possible to use types of wood which heretofore were considered unsuitable for the making of pipe bowls. Briar is no longer required and oak, maple and even soft woods or man-made materials can be used instead.

Still a further advantage of the embodiment in FIGS. 9 and 10 is that tests have shown that a user need never light up his pipe more than once. Once lit, the tobacco charge continues to combust until it is all burned up, evenly and totally.

The insert a may be made of any of several types of metal, e.g. steel, brass or the like. If desired, the insert a can be strictly tubular, i.e. instead of having the perforated bottom wall of one piece with the insert, the bottom wall can be replaced with a perforated disc similar to the one identified with reference numeral 8 in the preceding Figures. In such event the disc will be placed into the insert which has an outwardly extending flange at its lower end, in such a manner that the disc removably rests on the flange and can be removed by tapping it out.

I do not wish to be limited to the illustrated details but instead wish it to be understood that my invention is to be protected in accordance with the scope of the appended claims. I do wish to note that I prefer twelve ribs on my pipe bowl, but fewer or more might also be suitable.

I claim:

1. Anti-pollution combustion device, comprising a bowl having a tobacco chamber and an outside formed with a plurality of cooling ribs; a stem having a smoke passage communicating with said tobacco chamber and having a filter chamber interposed in said smoke passage for accommodation of a filter therein, said stem having a rear end provided with a mouthpiece; a liquid trap in said stem and communicating with said smoke passage intermediate said filter and said mouthpiece; a perforated disc lodged in said tobacco chamber of said pipe bowl above the point of communication of said tobacco chamber with said smoke passage and adapted to keep a charge of tobacco positioned upwardly of said point so as to prevent tobacco from contacting liquids collecting in said chamber below said disc; a ceramic compound coating lining said bowl; and a tubular metal insert mounted in said bowl surrounded by said compound, said disc being located at a lower end of said tubular insert.

2. A device as defined in claim 1, wherein said liquid trap comprises a port formed in said stem and having an opening, and a cap for removably closing said opening.

3. A device as defined in claim 2, wherein said opening is bounded by screw threads and said cap has mating threads provided thereon.

4. A device as defined in claim 1, wherein said lining is at least combustion-retarding so as to prevent combustion-caused damage to said pipe bowl.

5. A device as defined in claim 1, wherein said disc insert is of metallic material.

6. A device as defined in claim 1, wherein said filter is of fibrous material.

7. A device as defined in claim 1, wherein said cooling ribs extend circumferentially of said bowl.

8. A device as defined in claim 1, wherein said disc is of one piece with said tubular insert.

9. A device as defined in claim 1, wherein said coating holds said tubular insert in said bowl so that bowl and insert are integral with one another.

* * * * *